US010208756B2

(12) United States Patent
Stocks et al.

(10) Patent No.: US 10,208,756 B2
(45) Date of Patent: Feb. 19, 2019

(54) MOUNTING ASSEMBLY FOR AN ELECTRIC FAN

(71) Applicant: Hunter Pacific International Pty Ltd, Dural, NSW (AU)

(72) Inventors: David Stocks, Dural (AU); Philip Allen, Dural (AU); Scott Ibbotson, Dural (AU)

(73) Assignee: HUNTER PACIFIC INTERNATIONAL PTY LTD, Dural, NSW (AU)

( * ) Notice: Subject to any disclaimer, the term of this patent is extended or adjusted under 35 U.S.C. 154(b) by 133 days.

(21) Appl. No.: 13/651,982

(22) Filed: Oct. 15, 2012

(65) Prior Publication Data

US 2013/0136632 A1 May 30, 2013

(30) Foreign Application Priority Data

Nov. 25, 2011 (AU) ..... 2011253643

(51) Int. Cl.
*F04D 25/08* (2006.01)
*F04D 29/60* (2006.01)

(52) U.S. Cl.
CPC ..... *F04D 25/088* (2013.01); *F04D 29/601* (2013.01); *Y10T 29/49826* (2015.01)

(58) Field of Classification Search
CPC .. F04D 25/088; F04D 25/0606; F04D 29/601; H02K 7/08; H02K 7/0865; H02K 5/00; H02K 5/1675
USPC ..... 417/354, 423.12, 423.14, 425.15, 423.7; 310/89; 416/244 R
See application file for complete search history.

(56) References Cited

U.S. PATENT DOCUMENTS

| | | | | |
|---|---|---|---|---|
| 4,720,241 | A * | 1/1988 | Markwardt | F04D 25/088 416/170 R |
| 4,862,581 | A † | 9/1989 | Royer | |
| 5,059,844 | A † | 10/1991 | Anstine | |
| 5,256,037 | A † | 10/1993 | Chatelain | |
| 5,503,524 | A † | 4/1996 | Yu | |
| 5,687,016 | A † | 11/1997 | Seto | |
| 5,883,449 | A * | 3/1999 | Mehta et al. | 310/60 R |
| 6,310,415 | B1 † | 10/2001 | Horng | |
| 6,400,051 | B1 † | 6/2002 | Hsieh | |
| 2002/0093255 | A1 * | 7/2002 | Matsumoto | F04D 25/0613 310/64 |
| 2003/0210982 | A1 * | 11/2003 | Chen | 416/5 |
| 2003/0218396 | A1 * | 11/2003 | Hsieh | 310/89 |
| 2006/0286924 | A1 * | 12/2006 | Milana | 454/259 |
| 2008/0169732 | A1 | 7/2008 | Chang | |
| 2010/0040494 | A1 | 2/2010 | Yamamoto et al. | |
| 2011/0165002 | A1 * | 7/2011 | Noble | 417/423.7 |
| 2011/0171021 | A1 * | 7/2011 | VanOtten Tolman | 416/1 |

OTHER PUBLICATIONS

IP Australia. Patent Examination Report No. 1. Appln No. 2011253643. dated Oct. 18, 2012. (4 pages).

* cited by examiner
† cited by third party

*Primary Examiner* — Kenneth J Hansen
(74) *Attorney, Agent, or Firm* — Shutts & Bowen LLP

(57) ABSTRACT

A mounting assembly for a ceiling fan, adapted to attach a rotating fan blade assembly to a ceiling suspension and electric motor assembly. The electric motor assembly includes an electrical rotor and an electrical stator, the stator being horizontally disposed within the rotor and connected to the rotor via a double row angular ball bearing.

7 Claims, 8 Drawing Sheets

MOUNTING ASSEMBLY FOR AN ELECTRIC FAN

TECHNICAL FIELD

The invention relates to the field of the mechanical design of electrically operated ceiling fans. In particular it relates to an improved assembly and method for assembling the fan rotor and stator.

BACKGROUND OF THE INVENTION

Ceiling fans are conventionally constructed using one of two motor types: type (A) where a central shaft is attached to a stator, where said shaft is stationary while the blades are attached to a rotor which rotates about the periphery of the stator, or; type (B) where the central shaft is attached to the rotor with the blades attached thereto and said shaft rotates with both rotor and shaft surrounded or encompassed by the stator.

Fan motors of the type (A), where the rotor rotates around the periphery of the stator, require the rotor to be held in a fixed longitudinal and lateral position relative to the shaft and the stator. Typically this is achieved by the use of two bearings and two motor housings containing said bearings, these housings being made of resilient material such as sheet metal and of a thickness that yields a small amount of elastic deformation thus allowing them to be pressed around or otherwise attached to the rotor. The rotor is thus prevented from rectilinear motion but is allowed curvilinear motion. 'Steps' on the shaft allow correct longitudinal positioning of the bearings. The blades of the ceiling fan may be attached to the rotor by various means. The stationary body of the fan (if any), suspension mechanism, light fittings and trimmings may also be attached to the stationary shaft where it projects from the bearings by various means. Motors of this type are typically split-capacitor induction motors.

Fan motors of the type (B), where the stator is fixed around the periphery of the rotor and the rotor and shaft rotate within the stator, require the rotating shaft to be held in a fixed longitudinal and lateral position relative to the stator and any devices attached to it. Typically two bearings, or one bearing plus a bushing, are pressed into the stator, or housing made of resilient material such as sheet metal and of a thickness that yields a small amount of elastic deformation thus allowing it to be pressed around or otherwise attached to the stator. Steps on the shaft may allow correct longitudinal positioning of the bearings. The rotor and shaft is thus prevented from rectilinear motion but allowed curvilinear motion. The blades of the ceiling fan may be attached to the shaft by various means. The stationary body of the fan (if any), suspension mechanism, light fittings and trimmings may also be attached to the stator by various means. Motors of this type are typically split-capacitor or shaded-pole induction motors or brushless DC motors.

Electric motors of most types in general, when used for this purpose, require the rotor to be stabilised laterally so the electromotive forces generated between stator windings and rotor windings is translated into curvilinear motion and do not result in the rotor being pulled sideways and into contact with the stator. This is usually achieved by the bearings being spaced a suitable distance apart and the material housing the bearings being suitably resilient either by nature of the materials themselves or forces imposed by mechanical design.

For motors of the type (A) or (B), when used with ceiling fans, the bearings or combination of bearings and bushes add considerable height and bulk to the motor assembly, before taking into account the attachment of blades and the stationary body of the fan (if any), suspension mechanism, light fittings and trimmings. The height of the motor assemblies described as types (A) and (B) prevents conventional ceiling fans from adopting slim or thin body profiles.

The attachment mechanism residing between the body of the ceiling fan and the suspension mechanism requires attachment to the stationary shaft (as per type (A)) or to the stator (as per type (B)) and in either case adequate clearance must be provided from rotating parts, which again increases the height required by the body of the fan. This further restricts the minimum profile achievable with motors of these designs.

Accordingly, it is an object of the invention to provide a bearing assembly for a ceiling mounted fan that facilitates a slimmer or flatter design of a fan hub.

SUMMARY OF THE INVENTION

According to one aspect of the invention, there is provided a mounting assembly for a ceiling fan, adapted to attach a rotating fan blade assembly to a ceiling suspension and electric motor assembly, said electric motor assembly including an electrical rotor and an electrical stator, said stator being horizontally disposed within said rotor and connected to said rotor via a bearing. Preferably, the bearing is a double row angular contact ball bearing.

Preferably, said bearing is retained within the rotating components of the fan body, and most preferably the stator is adapted to at least partially receive said bearing within its profile. For example, this may be achieved by recessing the bearing carrier assembly into a pocket within the stator. This further enhances the ability of the fan designer to produce operational fans having a low, slim or thin design.

In the background discussion above, there are described some limitations on decreasing the profile height of a ceiling fan motor assembly due to the attachment mechanism having to be located above rotating parts on motors, as per (A) and (B). The present invention, including an attachment mechanism that is directly connected to non-rotating parts, lowers the profile height not by the method of attachment of said mechanism but by the removal of the bearing carrier conventionally located above the stator. The present invention allows the bearing carrier to be placed within the rotating parts only, and preferably locates it in a recess below the stator.

One further advantage of this 'gained' space is that it facilitates the addition of motor covers made from insulating materials, thus allowing the user, or other untrained personnel to safely access these areas without risk of damage to electrical components and motor windings.

According to another aspect of the invention, there is provided a ceiling fan having a low-profile central hub, incorporating a mounting assembly as defined above.

According to another aspect of the invention, there is provided a method of construction of a mounting assembly for a ceiling fan.

Now will be described, by way of a particular, non-limiting example, a preferred embodiment of the invention.

DETAILED DESCRIPTION OF THE INVENTION

Now will be described the invention as discussed above, and the method of assembling a ceiling fan using a single bearing to allow slim, thin and low profile designs that are not achievable with conventional assemblies.

Figure 1:
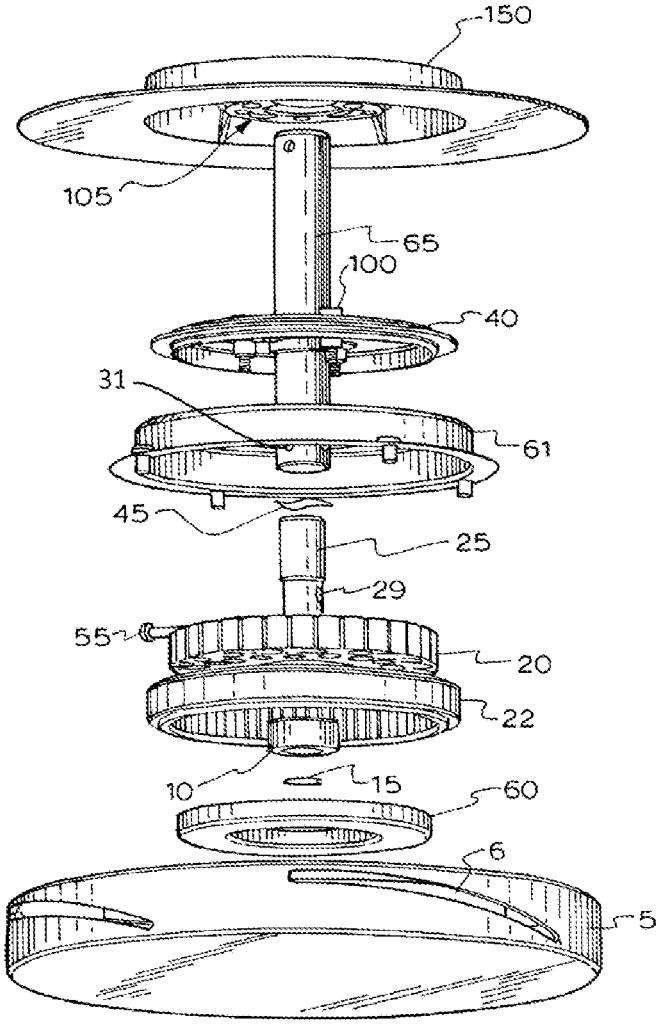
FIG. 1 is an exploded partial view of a ceiling fan assembly in accordance with the invention.
Figure 2:
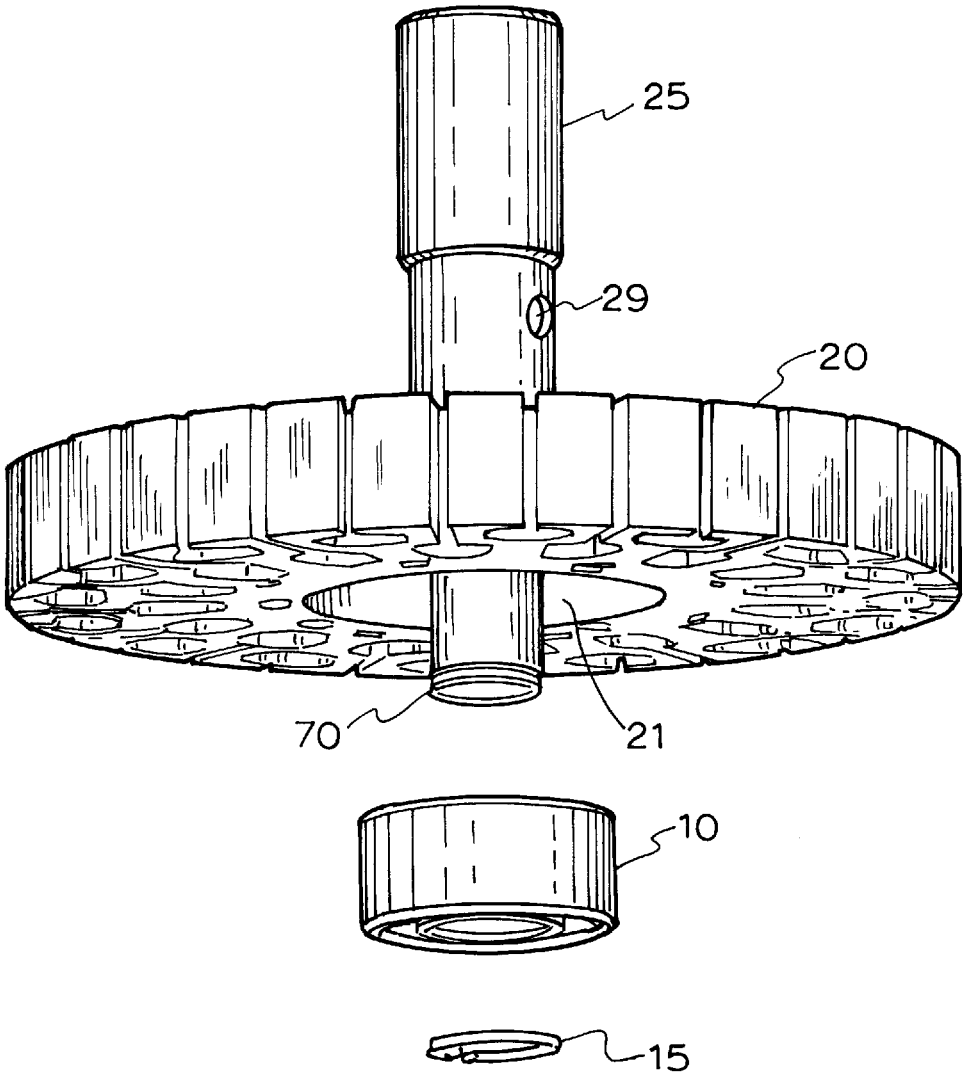
FIG. 2 is a detailed view of the assembly in FIG. 1.
Figure 3:
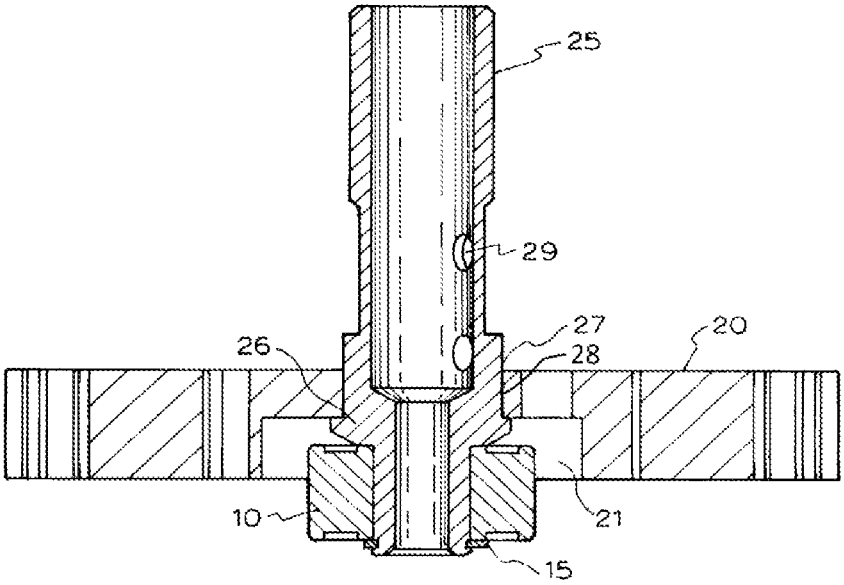
FIG. 3 is a sectional view of part of a ceiling fan assembly in accordance with the invention.

With reference to FIGS. 1, 2, and 3, the stator 20 is fabricated using laminated silicon steel in the conventional manner, but with a recess 21 incorporated into the lower surface of said stator 20. During assembly, the stator 20 is pressed over the motor shaft 25 until reaching a step 26 in the shaft. A flat 27 machined onto the round section of the shaft 25 aligns with a matching flat section 28 of the shaft hole in the stator 20. This orients the shaft and stator in a fixed position relative to one another and thus the wire entry/exit holes 29 in the shaft are aligned with the start and stop position of the stator windings.

The use of a single double-row angular-contact ball bearing 10 in construction of the ceiling fan is a key to the invention. Particular advantages are derived from locating the bearing 10 in a recess 21 within the stator 20 so the force couple that acts laterally on the bearing 10 is greatly reduced, preferably to a magnitude less than that which would typically be generated by a bearing located further from the centre of the stator 20, thereby overcoming the need to use two bearings located distant from the centre of the stator (typically above and below the stator, as per the prior art). The selection and use of a double row angular contact ball bearing 10 allows a single bearing to provide sufficient lateral load capacity to cope with rectilinear electromagnetic forces operating between stator windings and rotor windings.

In construction of a fan according to the invention, a single double-row angular contact ball bearing 10 (for example the NACHI 5202-2NS, as supplied in Australia by Nachi (Australia) Pty Ltd, of Unit 1, 23-29 South Street, Rydalmere, N.S.W. 2116), is pressed onto the motor shaft 25 until reaching a step 26 in the shaft. As shown in FIGS. 2 and 3, a circlip 15 snaps into a groove 70 to provide positive retention of the bearing 10 on the shaft 25.

Figure 4:
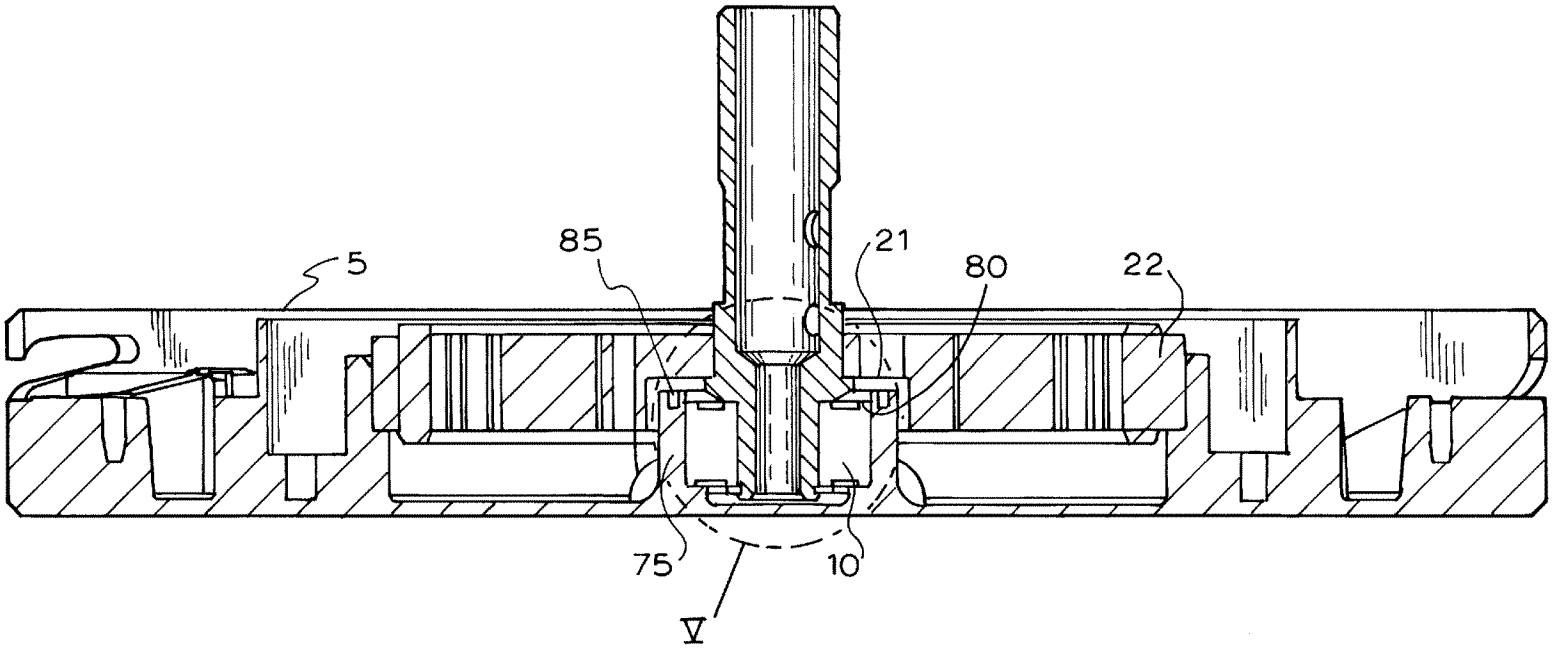
FIG. 4 is a sectional view of a fully assembled ceiling fan assembly in accordance with the invention.
Figure 5:
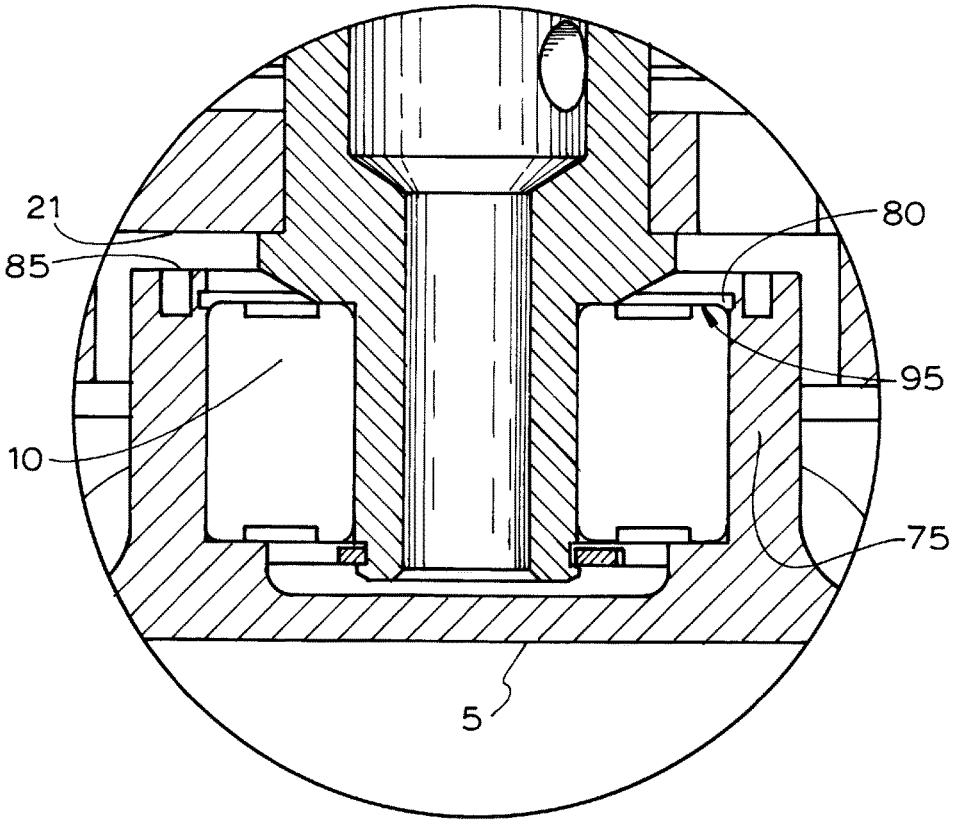
FIG. 5 is a detailed view of the assembly in FIG. 4.

The stator-shaft-bearing-circlip sub-assembly as detailed in FIG. 2 is then pressed into the central band 5 and positively retained in place by points of material displacement (pinch point) as shown in FIGS. 4 and 5 or with screws 85 impinging on the top edge of the outer shell of the bearing 95. Access to the pinch points 80 and/or retaining screws 85 is made via holes 90 placed in the stator 20 for this purpose. The same access holes may also be used during previous processes for positioning and rotating the stator during coil winding.

The stator 20 is positioned within the ring-shaped rotor 22. The rotor 22 is operably connected to the central band 5. The central band 5 features slots 6 designed to receive removable blades.

Figure 6:
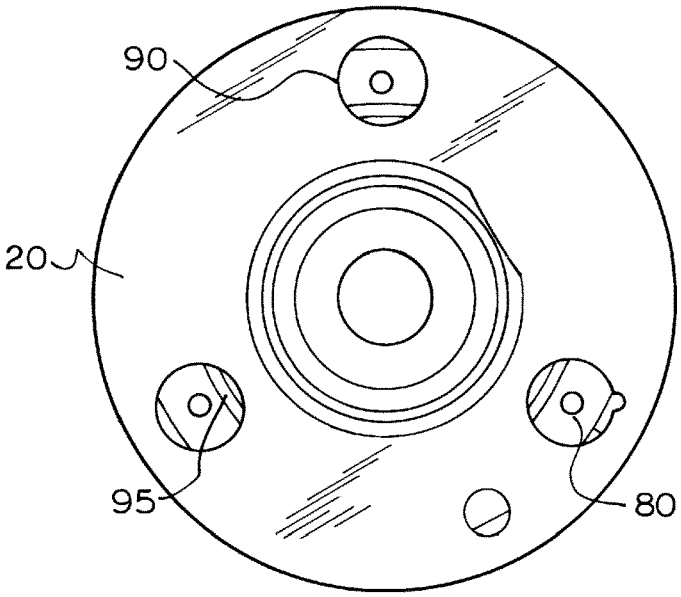
FIG. 6 is a top view of a part of the assembly of FIG. 4.
Figure 7:
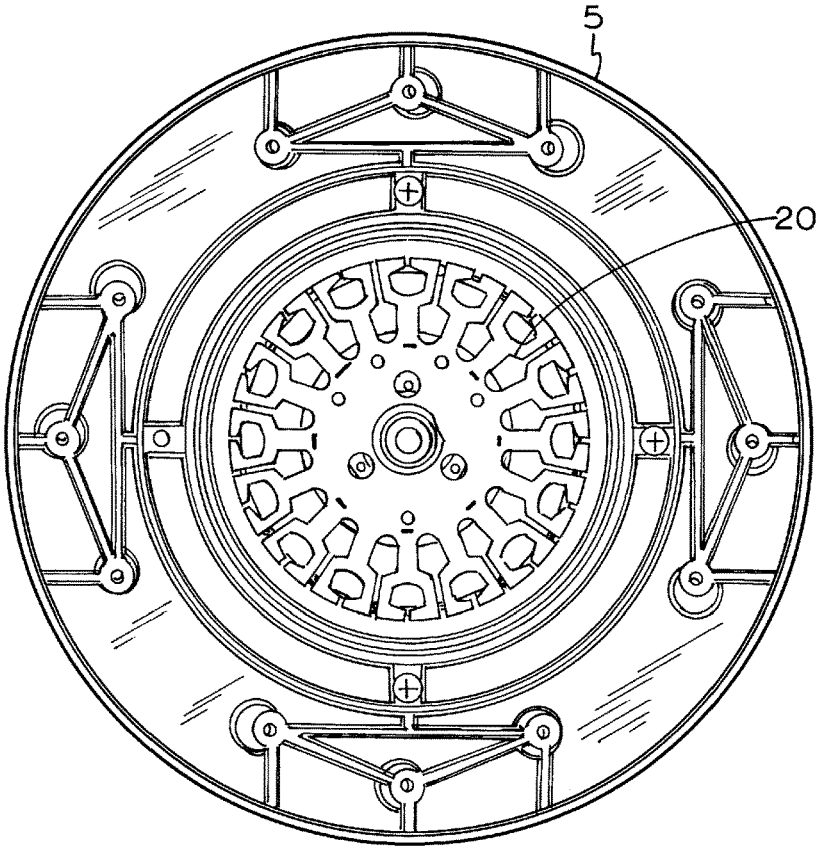
FIG. 7 is a detailed view of the assembly of FIG. 6.

Mechanical integrity and retention of rotating parts is assured since the bearing 10 cannot be displaced from the stationary shaft 25 due to the circlip 15 and groove 70. The central band 5 cannot be displaced from the bearing 10 due to the pinch points 80 and screws 85 as shown in FIG. 6.

With reference to FIGS. 4 and 5, a ceiling fan according to the invention places the bearing carrier 75 within the central band 5 and locates it in a recess 21 located in the bottom surface of the stator 20 (detailed in FIG. 5), thus avoiding the need to provide space for rotating parts or bearing carrier assemblies above said stator.

Electrical insulation and physical separation between stator coils and metallic parts of the central band 5 is provided by the bottom stator insulation cover 60 and the top stator insulation cover 40. A rotor cover 61 is also provided.

The top stator insulation cover 40 is retained by the cover screws 100 which have a head 101 with cross-section resembling a capital letter 'I'. The lower horizontal part of the 'I-shaped' head 101 presses onto the top surface of the top insulation cover 40 retaining it in position.

Figure 8:
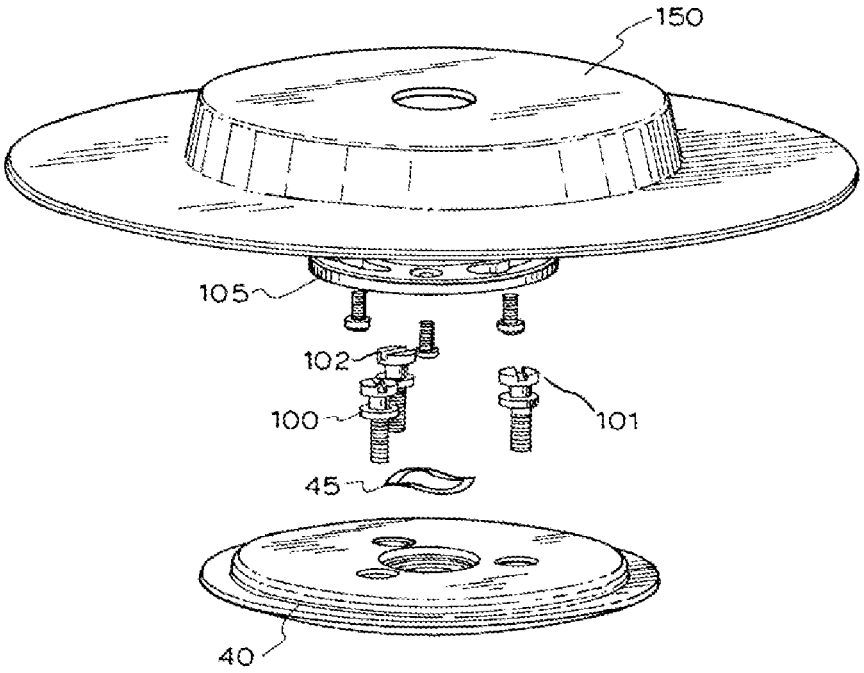
FIG. 8 is an exploded isometric view of a top cover assembly of the ceiling fan assembly of FIG. 4.

The ceiling fan motor and blade assembly is suspended from the ceiling by a rigid tube 65 conventionally referred to as a "down rod". A wave washer 45 slides over the motor shaft and rests within a recess formed in the top insulation cover 40, shown in FIGS. 8 and 9. The top of the motor shaft 25 is threaded and the lower end of the down rod tube 65 is threaded to match. The down rod is screwed onto the motor shaft and compresses the wave washer 45.

The down rod 65 is screwed onto the motor shaft 25 until the wave washer 45 is sufficiently compressed, and holes 29 drilled into the motor shaft 25 and holes 31 in the down rod 65 align. The wave washer 45 prevents play in the join between shaft and down rod and thus eliminates knocking and other noises. A locking pin 55 is inserted in the holes 29, 31 to additionally support the weight of the fan motor assembly and to provide an anti-torque device. This helps to prevent reactive motion from unscrewing or loosening the down rod, when starting the fan. The holes 29, 31 align, and the locking pin is able to pass therethrough, only when sufficient compressive force is exerted on the wave washer 45.

The locking pin 55 is tethered to the top insulation cover 40 so it cannot be misplaced. The tether is only of sufficient length to allow the pin 55 to be inserted into the holes 29, 31 in the down rod 65 and motor shaft 25. The thickness of the head of the locking pin is greater than the clearance distance between the top insulation cover 40 and the top cover 150 so unless the pin is inserted into the proper position (where adequate clearance exists) it is not possible for the user to install the top cover 150 due to obstruction by the tethered pin. The tether itself is not thick enough to cause obstruction. This provides an added safety feature.

Figure 9:
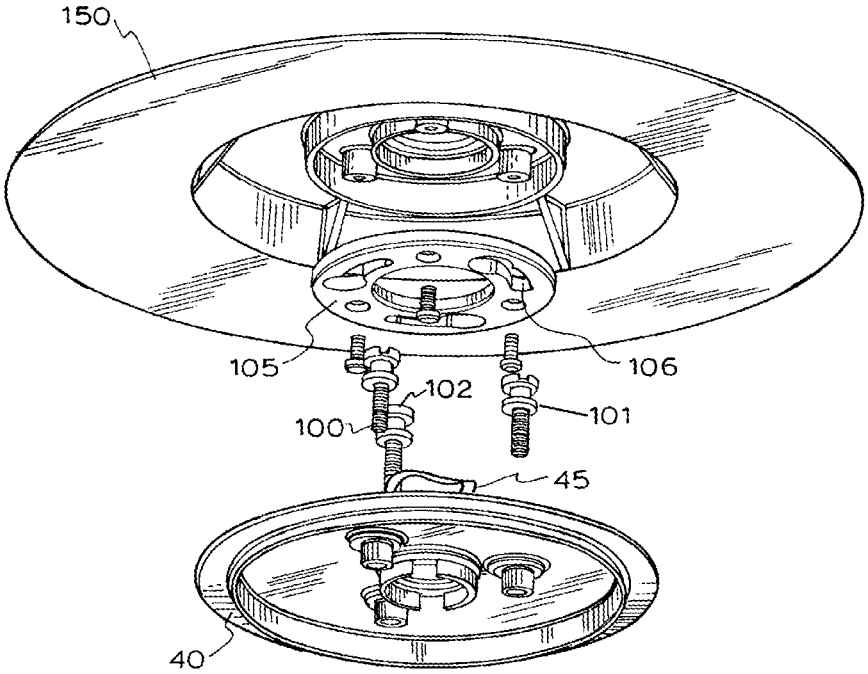
FIG. 9 is an alternative exploded isometric view of a top cover assembly as per FIG. 8.

The upper horizontal part 102 of the I-shaped head 101 of the cover screws 100 mate with a keyway ring 105, as per FIG. 9, fitted within the top cover 150 and used to secure the top cover in place. The top cover 150 is secured by rotating the cover approximately 30 degrees, so the narrower sections of the individual key-way slots 106 are engaged. The top cover 150 is removable and re-attachable by the user to install and/or remove the ceiling fan blades during installation or maintenance.

It will be appreciated by persons skilled in the art that the above described embodiments are not the only ways in which the invention can be put into practice. There are other alternative embodiments which, while different in some details, nevertheless fall within the scope of the invention.

The claims defining the invention are as follows:

1. A ceiling fan comprising a low-profile, central rotating hub housing an electric motor assembly, said electric motor assembly including an electrical rotor and an electrical stator horizontally disposed inside a cavity within said electrical rotor, the electrical stator including a central recess therein and being connected to said electrical rotor via only one rotary bearing, wherein a substantial portion of said rotary bearing is received within the recess of said electrical stator, wherein the rotor is operatively secured to the hub to rotate with the hub and the rotary bearing is operatively secured to the hub to rotate with the hub, a stationary shaft extending through and fixed to the stator recess and rotary bearing, wherein the stationary shaft includes a step portion along its length, said step portion having a first abutment surface facing in a first axial direction and a second abutment surface facing in a second axial direction opposite the first direction, wherein the stator abuts the first abutment surface and its recess extends axially past the step portion in the second axial direction and the rotary bearing abuts the second abutment surface within the stator recess.

2. The ceiling fan of claim 1 wherein the rotary bearing is a double row angular contact ball bearing.

3. The ceiling fan of claim 1 wherein the rotary bearing is retained within the electrical rotor.

4. The ceiling fan of claim 2 wherein the rotary bearing is retained within the electrical rotor.

5. The ceiling fan of claim 1, wherein the hub secures to the rotary bearing within the stator recess.

6. An electric motor assembly for a ceiling fan having a low-profile central rotating hub, said central hub housing an electric motor assembly, said electric motor assembly including an electrical rotor and an electrical stator horizontally disposed inside a cavity within said electrical rotor, the electrical stator including a central recess therein and being connected to said electrical rotor via only one rotary bearing, wherein a substantial portion of said rotary bearing is received within the recess of said electrical stator, wherein the rotor is operatively secured to the hub to rotate with the hub and the rotary bearing is operatively secured to the hub to rotate with the hub, a stationary shaft extending through and fixed to the stator recess and rotary bearing, wherein the stationary shaft includes a step portion along its length, said step portion having a first abutment surface facing in a first axial direction and a second abutment surface facing in a second axial direction opposite the first direction, wherein the stator abuts the first abutment surface and its recess extends axially past the step portion in the second axial direction and the rotary bearing abuts the second abutment surface within the stator recess.

7. A ceiling fan having a low-profile, central rotating hub and fan blades extending therefrom; said central hub housing an electric motor assembly, said electric motor assembly including an electrical rotor and an electrical stator horizontally disposed inside a cavity within said electrical rotor, the electrical stator including a central recess therein and being connected to said electrical rotor via only one rotary bearing, wherein a substantial portion of said rotary bearing is received within the recess of said electrical stator, wherein the rotor is operatively secured to the hub to rotate with the hub and the rotary bearing is operatively secured to the hub to rotate with the hub, a stationary shaft extending through and fixed to the stator recess and rotary bearing, wherein the stationary shaft includes a step portion along its length, said step portion having a first abutment surface facing in a first axial direction and a second abutment surface facing in a second axial direction opposite the first direction, wherein the stator abuts the first abutment surface and its recess extends axially past the step portion in the second axial direction and the rotary bearing abuts the second abutment surface within the stator recess.

* * * * *